US007255215B2

(12) United States Patent
Iannello et al.

(10) Patent No.: US 7,255,215 B2
(45) Date of Patent: Aug. 14, 2007

(54) BULK NOTE FEEDER ASSEMBLY FOR TABLE GAME VALIDATOR ASSEMBLY

(75) Inventors: Richard J. Iannello, Sebastopol, CA (US); James K. Bullock, Las Vegas, NV (US); Gwen D. Mathis, Las Vegas, NV (US)

(73) Assignee: JCM American Corporation, Las Vegas, NV (US)

( * ) Notice: Subject to any disclaimer, the term of this patent is extended or adjusted under 35 U.S.C. 154(b) by 51 days.

(21) Appl. No.: 10/958,946

(22) Filed: Oct. 4, 2004

(65) Prior Publication Data

US 2005/0121286 A1 Jun. 9, 2005

Related U.S. Application Data

(63) Continuation-in-part of application No. 10/863,059, filed on Jun. 7, 2004, which is a continuation of application No. 10/081,756, filed on Feb. 20, 2002, now Pat. No. 6,745,887.

(51) Int. Cl.
*G07F 1/04* (2006.01)
*G07F 7/04* (2006.01)

(52) U.S. Cl. ..... 194/206; 194/344

(58) Field of Classification Search ..... 194/350, 194/351, 344; 193/2 R, 8, 15, 17, 2 A
See application file for complete search history.

(56) References Cited

U.S. PATENT DOCUMENTS

| | | | | | |
|---|---|---|---|---|---|
| 1,391,129 | A * | 9/1921 | Lee | 271/278 |
| 2,288,770 | A * | 7/1942 | Armbruster | 235/487 |
| 3,608,690 | A * | 9/1971 | Morrow et al. | 194/206 |
| 3,734,261 | A * | 5/1973 | Richer | 194/206 |
| 4,449,050 | A * | 5/1984 | Kamhi | 250/455.11 |
| 4,510,381 | A * | 4/1985 | Fukatsu | 194/350 |
| 4,619,101 | A * | 10/1986 | Havey et al. | 53/117 |
| 4,733,765 | A * | 3/1988 | Watanabe | 194/206 |
| 4,976,419 | A * | 12/1990 | Bartoes et al. | 270/45 |
| 5,129,330 | A * | 7/1992 | McKay et al. | 109/59 R |
| 5,156,250 | A * | 10/1992 | Parish et al. | 194/348 |
| 5,186,334 | A * | 2/1993 | Fukudome et al. | 209/534 |
| 5,662,202 | A * | 9/1997 | Suris | 194/206 |
| 6,435,329 | B1 * | 8/2002 | Amari et al. | 194/206 |
| 7,140,607 | B2 * | 11/2006 | Graef et al. | 271/122 |

* cited by examiner

*Primary Examiner*—Patrick Mackey
*Assistant Examiner*—Mark J. Beauchaine
(74) *Attorney, Agent, or Firm*—DLA Piper US LLP

(57) ABSTRACT

A bill acceptor assembly for accepting bills, vouchers, scrip, tickets and/or currency at a gaming table. The bill acceptor assembly includes a note feeder having an intake opening adapted to receive one or more notes. The note feeder may be mounted to a table to allow a user to insert notes into the intake opening. The notes are passed to a validator located underneath the table. The validator is configured to validate the notes and separate valid notes from invalid notes. The validator passes the valid notes to a cash box located underneath the table and passes the invalid notes to a rejection slot formed on the note feeder.

16 Claims, 9 Drawing Sheets

FIG. 3
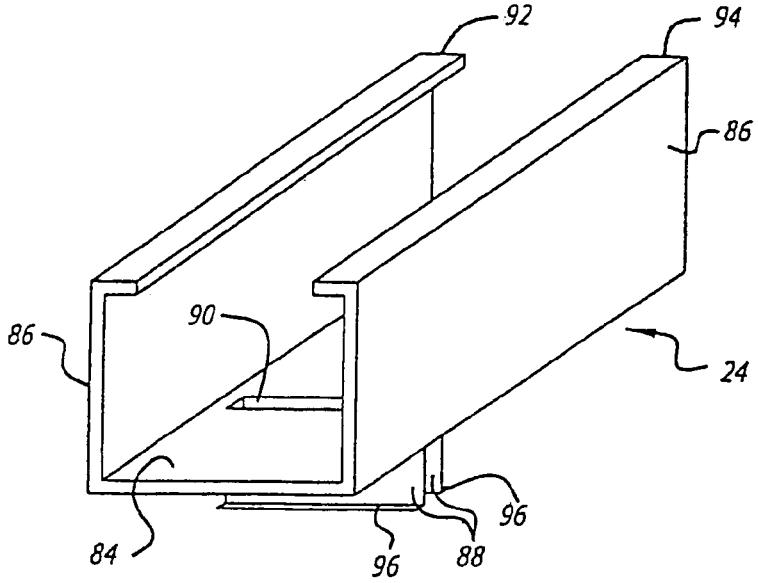
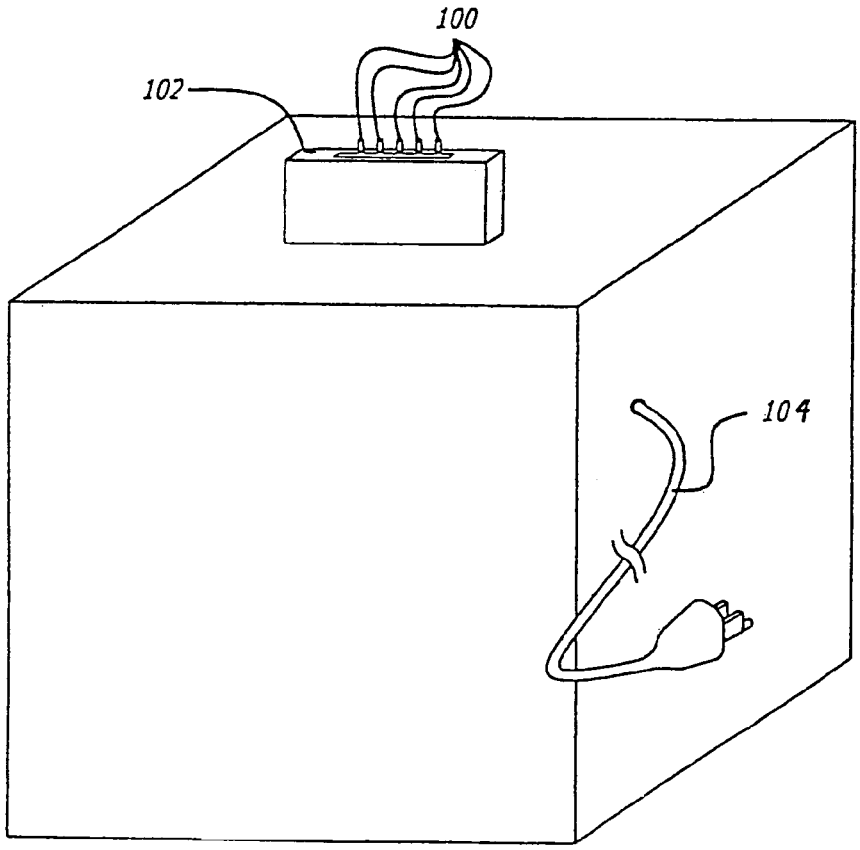
FIG. 4

FIG. 8
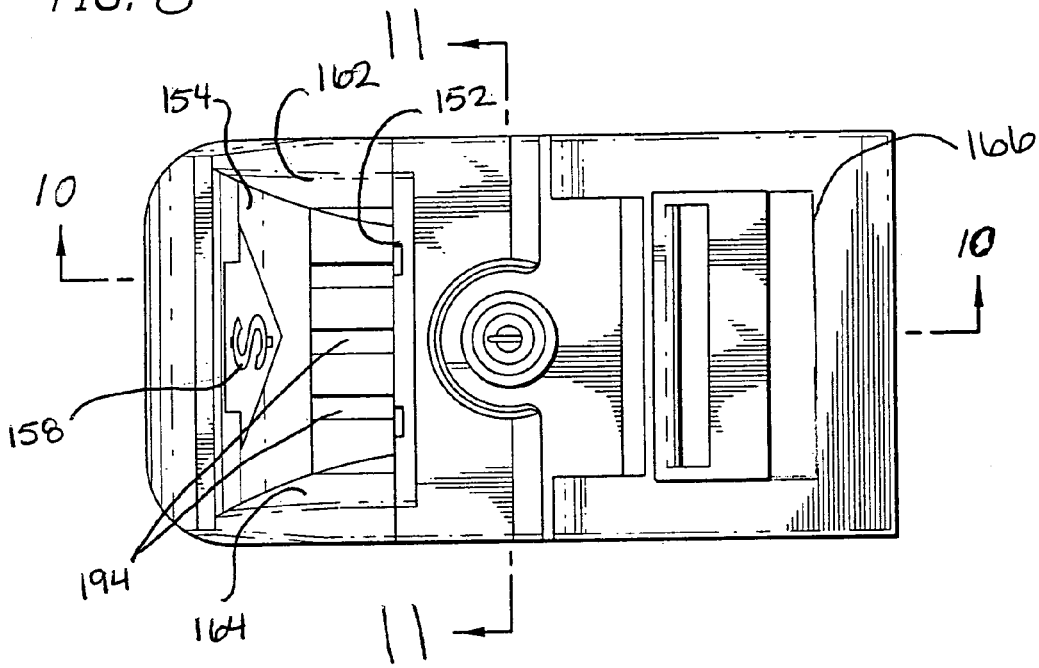
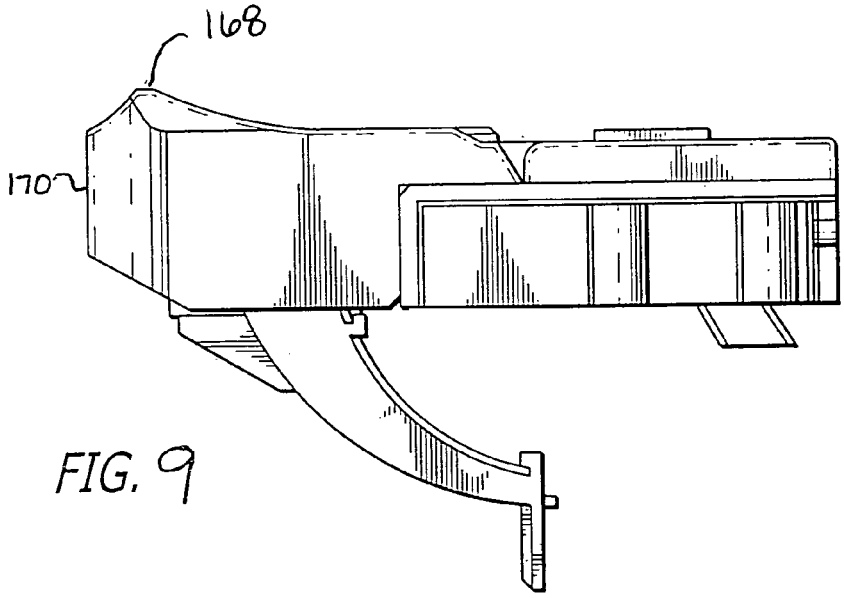
FIG. 9

BULK NOTE FEEDER ASSEMBLY FOR TABLE GAME VALIDATOR ASSEMBLY

RELATED APPLICATIONS

This application is a Continuation-In-Part of U.S. application Ser. No. 10/863,059, filed on Jun. 7, 2004 which is a Continuation of U.S. application Ser. No. 10/081,756, filed Feb. 20, 2002, entitled Gaming Table Validator Assembly, now U.S. Pat. No. 6,745,887.

BACKGROUND OF THE INVENTION

1. Field of the Invention

The present invention is directed to a bill acceptor adapted for mounting on a gaming table, kiosk dispensing assembly or checkout counter. In particular, the invention relates to the design and operation of a bill acceptor which can accept a stack of individual notes in a receiving slot or bulk note feeder mounted to the gaming table, kiosk or counter, and the method by which it processes the notes one at a time and passes validated notes through to a secure cash box.

2. General Background and State of the Art

Conventional gaming tables located in casinos are generally used to play games such as blackjack, poker, roulette, baccarat, and craps. The table may have an outer periphery containing a plurality of player locations and a dealer's location located generally opposite the player locations. From the dealer's location, the dealer controls the pace and operation of the game including for example dealing the cards, paying winning wagers and collecting losing wagers. The operation of a gaming establishment is highly regulated and strictly monitored. Systems adapted for use in the gaming industry are thus required to meet very high design and reliability standards.

A dealer's responsibilities include exchanging currency or notes received from a player, or credits provided to a player, for casino chips. Generally, when a player wants to exchange currency or notes for chips at the gaming table, the player gives the currency or notes to the dealer. Notes, as used herein, can include local and foreign currency, casino scrip, and casino issued tickets. The dealer counts out and then spreads the currency or notes on the playing surface of the gaming table. Video surveillance systems view each of the tables and may confirm the dealers counting of received notes. The dealer is sometimes required to notify a Pit Boss that the dealer is exchanging currency or notes. The Pit Boss in turn must be a running accounting of the money in play on each of the tables that he or she is supervising. After receiving an approval from the Pit Boss, the dealer accepts the currency or notes and deposits them into a slot accessible from the playing surface of the gaming table. The slot leads to a channel for transporting the currency or notes from the slot to a cash box located below the playing surface. A plate may be used to push the currency or notes into the slot and ensure that the currency or notes properly fall into the cash box. Generally, the cash box beneath the gaming table does not include a stacking assembly to receive and stack in an organized manner the notes received, thus, when the cash box is removed from the gaming table and taken to the counting room, the notes must be manually removed, sorted, stacked and counted. Gaming regulations may require that the receipts on every table be audited at least once per day, thus requiring a manual sort and count for each active gaming table at least once per day.

The revenues received on the gaming tables are a significant source of income for a casino. Accordingly, the high volume of currency or notes exchanged invites the risks of receiving counterfeit currency or notes. Unlike slot machines, wherein the implementation of integrated bill acceptors in the slot machines has diminished the casinos' risk of receiving counterfeit currency, most gaming tables remain susceptible to this risk. Due to the increased sophistication of counterfeiters and the increasing difficulties in discriminating between authentic and counterfeit currency, the manual or dealer inspection method of accepting currency on gaming tables is inadequate to protect casinos from currency fraud.

Further, as the use of casino scrip and casino tickets increases or other types of cash equivalents are adopted, there is a risk that these forms of revenue could be compromised or counterfeited. Accurate accounting of these alternative forms of notes may require that they be validated upon receipt, and the validation or authentication may require electronic communication with a central server system.

A few attempts have been made to patent the use of a bill acceptor assembly on electronic gaming tables. For example, U.S. Pat. No. 5,775,993 ("the '993 patent") issued to Fentz et al. discloses a bill acceptor assembly mounted at each player station located around an electronic roulette wheel. Similarly, in U.S. Pat. No. 5,588,650 ("the '650 patent"), each player console located around an automated roulette wheel includes a bill acceptor. In both of these patents, a computer, not a human being, directs the game. A player can insert money into the bill acceptor to earn credits at any time, even though the player may not be able to place a bet until the next betting period. Yet, both the '993 patent and the '650 patent have two fundamental flaws. First, both patents use traditional single-feed bill acceptors where the player must insert one note at a time into the bill acceptor. The bill acceptors in the '993 patent and the '650 patent are not designed to accept multiple notes at one time. At a gaming table, players may start their betting with a large sum of money which, in the configuration of the '993 or '650 patents, would require each player to feed each note one at a time into the bill acceptor. The effort involved in feeding each note can be time consuming and frustrating, and even more so if the bill acceptor does not accept every note on the first feeding attempt.

Second, incorporating a bill acceptor into a computerized gaming table does not involve the same difficulties as incorporating a bill acceptor into a conventional gaming table operated by a human dealer. On the computerized gaming table, a computer using preprogrammed software manages each player's credits, operates the game, calculates and pays out all winnings, and collects any losing wagers. No casino tokens or notes are dispensed until a player cashes out. On the other hand, a gaming table dealer or operator has to do all of the cash intake, chip or token distribution and wagering transaction functions by himself or herself. In addition, the operator is given the responsibility of watching each player to ensure that he/she does not cheat. Neither the '993 patent nor the '650 patent explain or address the many concerns of how to incorporate the bill acceptor into a human operated gaming table. For example, neither patent discloses how the operator would know how much money has been inserted into the bill acceptor. This disconnect in information would prevent the operator from knowing how many tokens to give back to the player.

Accordingly, a system for accepting valid currency and rejecting counterfeit currency on a conventional gaming table would be beneficial to the gaming industry. Such a system would increase the casino's profitability by decreasing the amount of counterfeit currency it may receive. Moreover, a bill acceptor capable of accepting and validating a stack of notes would significantly decrease the delay involved in feeding one note at a time into the bill acceptor. In view of the degree of sophistication involved and the necessary design and operation of such a bill acceptor that will be serviceable in the gaming industry, it may also be appreciated that a bill acceptor satisfying the requirements of the gaming industry will have wide application to a number of applications, including for example self serve kiosks and checkout counters.

SUMMARY OF THE INVENTION

The present invention is directed to a note or bill acceptor, which will accept various notes, located on a gaming table. Due to the expansion of the types of currency and currency substitutes which are accepted by current bill acceptors on current casino gaming machines, bills, vouchers, script, tickets and currency will be hereinafter collectively referred to as "notes." The bill acceptor of the present invention is directed to providing an efficient way to accept notes on a gaming table and simultaneously discriminate between authentic and counterfeit notes. Accordingly, a bill acceptor for accepting and rejecting notes on a gaming table is set forth which includes a validator assembly having a slot for receiving notes and an associated transport mechanism to pull the notes from the slot through the validator assembly. If the note is not authentic, the note is transported to a bill rejection slot. If the note is authentic, the transport mechanism directs the note through an enclosed path down through (or around) the surface of the gaming table to a cash box. The bill acceptor is mounted to the gaming table with a mounting bracket, preferable so as to take advantage of the existing slot in the top of the gaming table into which the dealer or operator would normally insert the notes.

According to the present invention, a player or the dealer places notes on a bezel leading to a bill insertion slot of the bill acceptor, which is preferably capable of receiving multiple notes. The bill acceptor removes one note at a time from the others and uses various optical and magnetic sensors to determine the authenticity of each note. If the note does not meet the standards of the bill acceptor for any reason, the note is rejected. The transport mechanism will divert the rejected note to the bill rejection slot, where the note is returned to the playing surface of the gaming table. If the note is valid, a transport mechanism conveys the note to a cash box for storage. A display will indicate the total value of the notes received. An override "Accept" button, to allow the dealer to accept a questionable note is also included to allow the dealer to accept the notes, even though the bill acceptor is rejecting them.

The accepted notes may be securely and orderly stacked inside the cash box if the cash box is configured to include a stacker. A lock on the cash box door prevents unauthorized access to the notes inside the cash box. Moreover, the bill acceptor and cash box can be assembled from more than one component to ensure ease of installation onto the gaming table. Further, a bill guard can be installed around the bill acceptor to minimize the possibility that a player would reach over the gaming table and attempt to remove the notes as they were being fed into or rejected from the bill acceptor.

The above described and many other features and advantages of the present invention will become apparent from a consideration of the following detailed description in conjunction with the accompanying drawings.

BRIEF DESCRIPTION OF THE DRAWINGS

FIG. 3 is a perspective of a mounting bracket for mounting the bill acceptor to the gaming table.

FIG. 4 is a perspective view of a cashbox housing and power assembly of the bill acceptor.

FIG. 8 is a top view of a note feeder portion of the bill acceptor of FIG. 7.

FIG. 9 is a side view of the note feeder portion of the bill acceptor of FIG. 7.

DETAILED DESCRIPTION OF THE PREFERRED EMBODIMENTS

Figure 1:
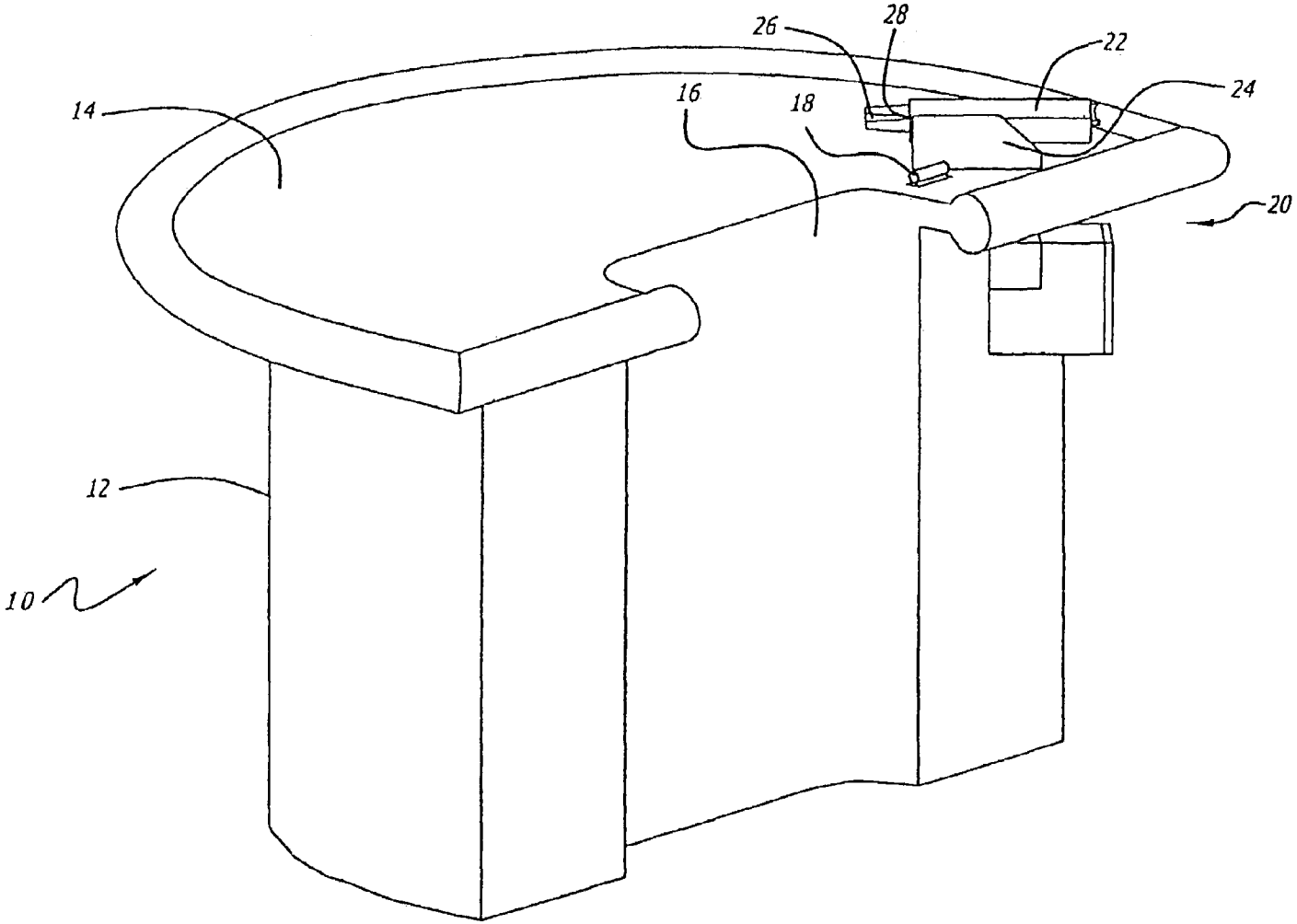
FIG. 1 is a perspective view of a gaming table with an installed bill acceptor.

FIG. 1 provides a perspective view of a gaming table 10 having a base 12 and a playing surface 14. The gaming table 10 has a dealer station 16 opposed by semi-circularly arranged player positions. The gaming table 10 will normally have a drop slot 18, positioned proximate the dealer station 16, which defines a hole in the gaming table 10 and allows for notes to be deposited into a cash box contained proximate the base 12, or within the base. While a card type gaming table is depicted, the invention is applicable to other types of gaming tables.

As further illustrated in the exemplary embodiment of FIG. 1, a bill acceptor 20 is positioned on the playing surface 14 of the gaming table 10. The bill acceptor 20 includes a housing 22 and a mounting bracket 24 to secure the housing 22 to the gaming table 10. The housing 22 includes a bezel 26 upon which notes can be stacked and sequentially fed through a slot 28 into the bill acceptor 20. The slot 28 generally comprises an opening dimensioned to receive the notes.

Figure 2:
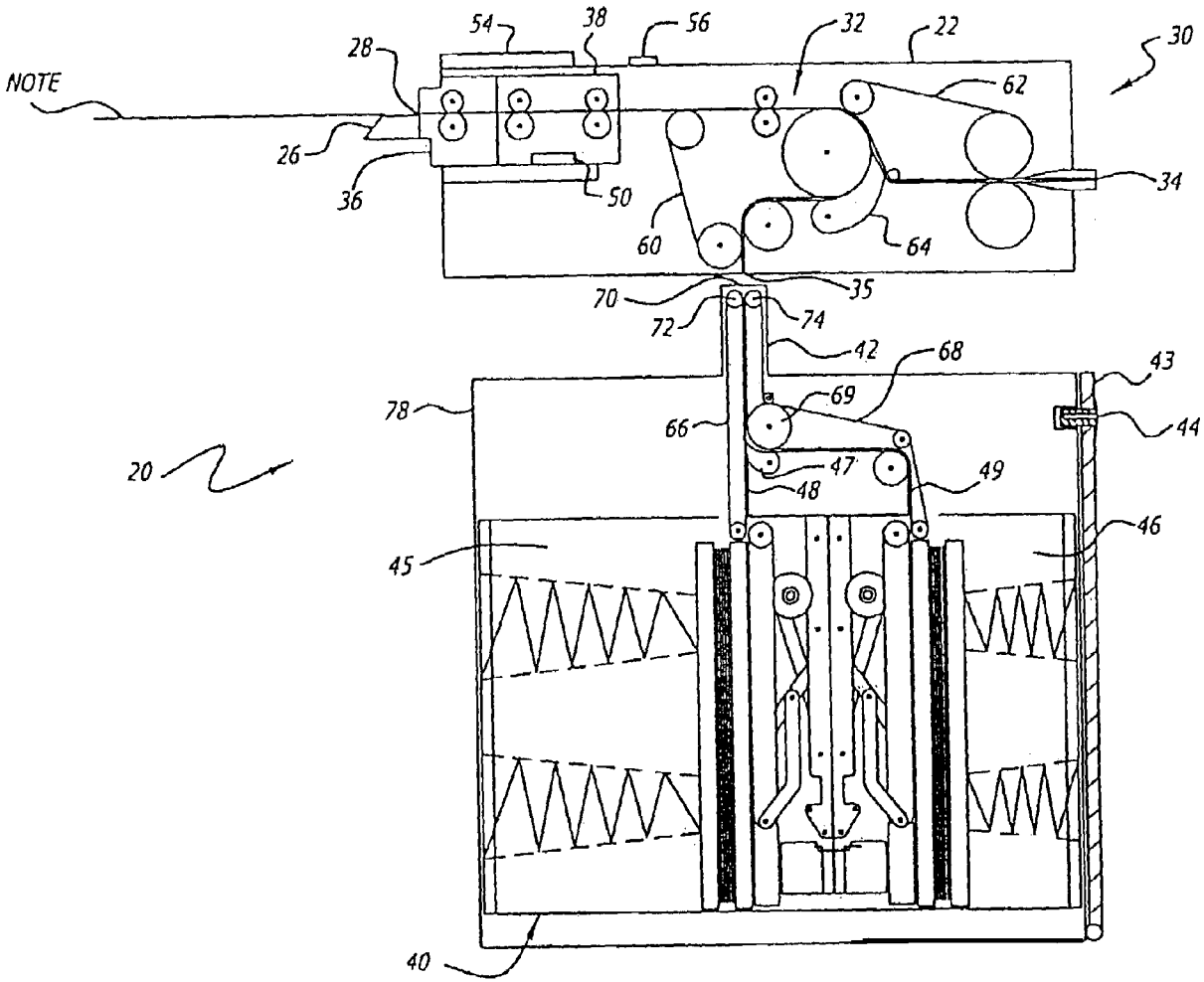
FIG. 2 is a representative cross sectional view of the bill acceptor and a cash box assembly.

FIG. 2 depicts a cross-sectional view of the bill acceptor 20 and an associated cash box 40 removed from the gaming table 10 of FIG. 1. Within the bill acceptor 20, the notes are transported through a validator assembly 30 by a transportation assembly 32, as discussed below. A bill separator 36 may be located proximate the slot 28. The notes pass from the bill separator 36 through a bill discriminator 38 to determine if the notes are authentic. The bill acceptor 20 also includes, at an opposite end of the housing 22, a bill dispenser slot 34. In the event that the bill discriminator 38 determines that a note inserted into the validator assembly 30 is not authentic, the transportation assembly 32 passes the note through the housing 22 to the bill dispenser slot 34.

As illustrated, notes are to be inserted into the bill acceptor 20 through the slot 28. Notes rejected by the validator assembly 30 are ejected through the bill dispenser slot 34. Valid notes are deflected downward through a slot 35 located on the underside of the housing 22 which is to be positioned over the drop slot 18 of the gaming table 10. In an alternative embodiment, the notes are directed to a location along the back edge of the gaming table 10 to then be transported to the cash box 40.

A power assembly 42 draws the valid notes away from the validator assembly 30 and deposits them into the cash box 40, which is to be mounted below the playing surface 14 of the gaming table 10. The power assembly 42 also supplies power to and exchanges information with the validator assembly 30 through a power connector located on the underside of the housing 22 as discussed below. The cash box 40 is contained within a cash box housing 78 having a cash box door 43 and a door lock 44 prevent unauthorized access to the contents of the cash box 40. The cash box 40 may simply be an open container having a slot in the top through which the notes are inserted. As depicted in FIG. 2 the cash box 40 receives and stacks the notes. While the cash box 40 may have a single stacker for all of the notes, it may be preferable to have two stacker sections as depicted, wherein first stacker section 45 receives and neatly stacks currency. A second stacker 46 can be used to stack a selected currency denomination or alternatively all non-currency notes accepted by the bill acceptor. As another alternative, the second stacker 46 could be used to store "fill slips" signifying additional chips being brought to the gaming table. Thus, the second stacker 46 could be used to store all documents, or all non-currency items, received by the bill acceptor. Accordingly, for this dual stacker cash box, the power assembly 42 will have a transport system and a deflector 47 to allow the notes to be directed to the appropriate stacker along a first transport path 48 or a second transport path 49.

The validator assembly 30 contains a circuit board mounted validator processor 50 which is also preferably connected to a central computer or server (not shown) of the casino. The validator processor 50 has various processing capabilities which are known in the art. Upon receipt of a note and determination of validity, a signal is sent to the casino processor or server signifying receipt as well as the denomination of the note. The value of the notes accepted by the validator assembly 30 can then be displayed on an LCD display 54.

There may be situations where some or all of the notes received are rejected from the validator assembly 30 even though it may be apparent to the dealer that the rejected notes are authentic. In this and other situations, the dealer may want to accept the notes in spite of the refusal of the validator assembly 30. To override the decision of the validator assembly 30, the dealer could activate an override input, such as an Accept button 56 which is electrically connected (not shown) to the validator processor 50. Pressing the Accept button 56 will force the validator assembly 30 to accept the notes and the transportation assembly 32 to transport the notes to the cash box 40. Software associated with the bill acceptor 20 can be provided to keep track of the number of notes received as a result of the dealer overriding the validator assembly 30.

If a player wants to place a bet with a dealer operating a casino game on the gaming table 10, casinos generally require the player to use the casino's own tokens to play. The player may already have casino tokens in possession or may give notes to the dealer who will exchange the notes for an equivalent value of casino tokens. To validate the notes received from the player, the dealer or player places the stack of notes on the bezel 26. The bill separator 36 pulls off one note at a time through the slot 28. The technology of bill separators is known in the art, which includes feeding devices such as printers, photocopiers, currency counters, and automated teller machines that feed one sheet of paper, such as a note, from a stack of paper or notes.

The notes are then pulled into the bill discriminator 38 by the transportation assembly 32. Because they are electrically connected to one another, the bill discriminator 38 can instruct the transportation assembly 32 to direct and transport validated notes into the cash box 40 and invalid notes to the bill dispenser slot 34. The transportation assembly 32 includes belts 60 and 62 that transport the note from the bill discriminator 38 to the deflector 64. Depending on the authenticity of the note processed, the bill discriminator 38 will send a signal to a deflector 64 which directs the pathway of the note through the validator assembly 30. If the note is authentic, the deflector 64 will remain in an initial position to direct the notes downwards towards the cash box 40. In the event the note is not authentic according to the bill discriminator 38, the deflector 64 moves from the initial position to a secondary position to deflect the note to an exit or horizontal pathway out of validator assembly 30.

It is understood that the transportation assembly 32 discussed above is an exemplary embodiment for illustration purposes only. Other transportation systems well known or apparent to one skilled in the art are to be included within the scope of the present invention. In addition, in an alternative embodiment, the slot 28 and the bill dispenser slot 34 may be the same.

As illustrated in the cross-sectional view of FIG. 2, the transportation assembly 32 transports valid notes past the deflector 64 to slot 35, which is positioned opposite a narrow extension of the power assembly 42, configured to extend up through the drop slot 18 of the gaming table 10. At the top of the narrow extension is a slit 70 into which the notes are directed. After entering the slit 70, the note passes between two wheels 72 and 74, driven by belts 66 and 68, respectively which draw the note down towards the cash box 40 and away from the validator assembly 30. The belt 66 extends down to the top of the cash box 40 to direct notes to the first stacker 45 of the cash box 40 if a deflector 47 is in an initial position according to the type of note. Belt 68, driven by a motor drive 69 and passing over or around various idler wheels, drives belt 66 and controls the direction of notes directed to the second stacker 46 of the cash box 40 if the deflector 47 moves to a second position.

The bill acceptor 20 may be composed of multiple modules that facilitate installation on a gaming table 10, including for example the mounting bracket 24, the validator assembly 30, and the cash box housing 78 which contains the power assembly 42 as well as the cash box 40. The validator assembly 30 can be an independent component and compact assembly, for example, about the width and length of two U.S. currency bills placed consecutively lengthwise. The mounting bracket 24 is adapted to receive and securely hold, the validator assembly 30 to the gaming table 10.

As illustrated in FIG. 3, the mounting bracket 24 may have a base plate 84 that is connected to two plates 86 extending upward and two plates 88 extending downward. The base plate 84 has an opening 90 that is similar in size to the opening of the drop slot 18. The upward plates 86, which rise upward from the base plate 84 and contain overhangs 92 and 94, secure the validator assembly 30 from the top, underside, and each side parallel to the length of the validator assembly 30. A locking mechanism may be provided on the validator assembly 30 so that it can mate and lock with a lock receiver to secure the validator assembly 30 to the mounting bracket 24.

The plates 88, which extend downward from the base plate 84, are parallel to the wider wall of the drop slot 18. The lower ends of the plates 88 extend down the full length of the drop slot, 18. At the lower end, the plates 86 may include flanges 96 that clip to the underside of the gaming table 10. To install the mounting bracket 24, the plates 88 are inserted into and pushed through the drop slot 18. After the flanges 96 extend past the end of the drop slot 18, the flanges 96 grip onto the gaming table 10, preventing the removal of the mounting bracket 24. To remove the mounting bracket 24 from the gaming table 10, the flanges 96 must be squeezed together from below the gaming table 10.

As illustrated in FIG. 4, the top of the narrow extension of the power assembly 42 includes a plurality of pin contacts 100 located extending from the power assembly 42 toward the validator assembly 30. The pin contacts 100 may be spring-loaded to maximize contact between the pin contacts 100 and contacts located on the base of the validator assembly 30. The pin contacts 100 and contacts on the validator assembly 30 are made of alloys that allow transfer of electrical power and data between the validator assembly 30 and the power assembly 42. Alternatively, pin contacts 100 may be used primarily to transfer power from the power assembly 42 to the validator assembly 30, whereas an optical coupling device 102 on the power assembly 42 communicates with an optical coupling device on the validator assembly 30 to transfer data information.

The pin contacts 100 are attached to a power supply and controller in the power assembly 42. A cable 104 can be provided to couple power to the power assembly 42 and also electrically couple the controller of the power supply 42 to a computer server (not shown) in the casino. Alternatively, wireless technology can be used to communicate information between the bill acceptor 20 and a computer server (not shown) in the casino.

Figure 5:
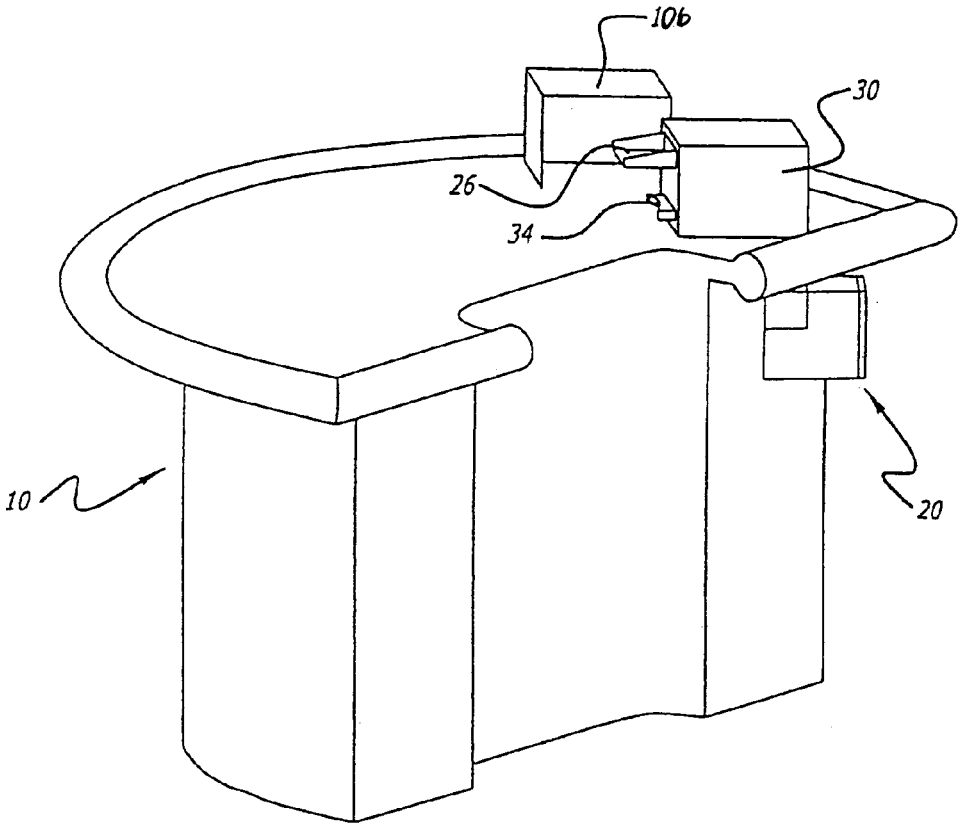
FIG. 5 is a perspective view of an alternative configuration for a bill acceptor and a bill guard installed on a gaming table.

As illustrated in FIG. 5, a bill guard 106 attaches to the gaming table 10 and is positioned near the bill acceptor 20. The bill guard 106 minimizes the possibility that a player could reach onto the gaming table and remove the notes as they were being fed into or rejected from the bill acceptor. The bill guard 106 can be made of a translucent material such as high impact plastic. The bill guard 106 will allow the dealer and players to watch the bills as they are inserted into or rejected from the validator assembly 30. The bill acceptor 20 depicted in FIG. 5 is an alternative embodiment, where the bezel 26 and the bill dispenser 34 are positioned on the same side of the validator assembly 30.

Figure 6:
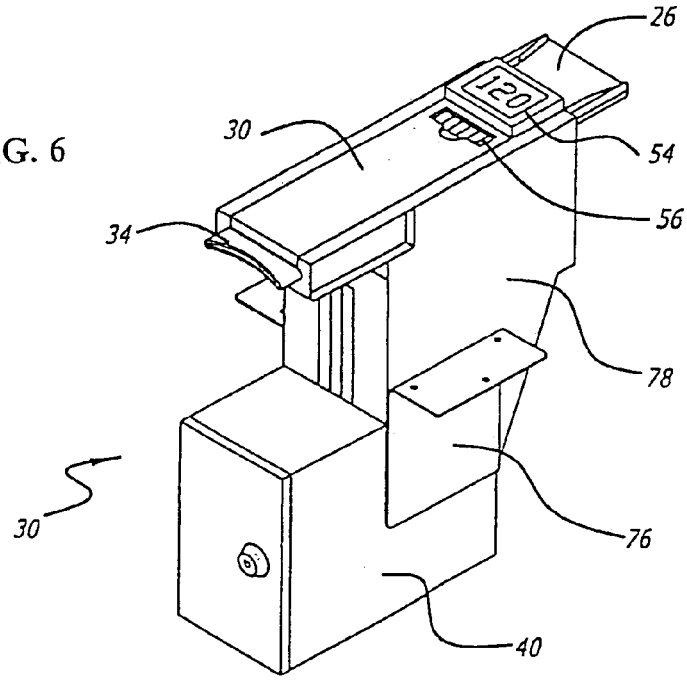
FIG. 6 is a perspective view of another alternative embodiment of a bill acceptor for mounting on a gaming table.

As depicted in an alternative embodiment in FIG. 6, the bill acceptor 20 is enclosed within an integrated housing 78 containing the cash box 40. To install the bill acceptor 20 on the gaming table 10, a hole is cut into the gaming table 10. The hole may need to be larger than the drop slot 18. The bill acceptor 20 is mounted through this hole such that the validator assembly 30 is above the playing surface 14 and the cash box 40 is below. Mounting members 76 are provided to secure the bill acceptor 30 to the gaming table 10. The internal components of the bill acceptor 20 in the exemplary embodiment, such as the transportation assembly 32, bill separator 36, and the bill discriminator 38, would be used in this alternative embodiment.

In view of the foregoing discussion, it may be readily understood that alternative embodiments are contemplated. For example, a slot for receiving money can be located proximate to each player position. Because the slot includes an opening adapted to receive notes, the slot could be located on the playing surface of the gaming table, along the border of the gaming table or under the playing surface of the gaming table. A player could insert a note into the slot or place the note on a bezel leading to the slot. A bill separator positioned proximate the slot could pull off one note at a time from the bezel. A transportation assembly generally similar to the system disclosed above would transport the note to a bill discriminator. There may be at least one bill discriminator per table to validate notes received from the slots. Valid notes may be transported to one central cash box or a plurality of cash boxes per gaming table. If one bill discriminator is installed proximate to each player position, a cash box may be installed proximate to each bill discriminator. This increases the number of cash boxes that need to be replaced by the casino personnel, but it also increases the cumulative note storage capacity on a gaming table. In addition, the increased storage capacity may decrease the frequency of replacements of filled cash boxes with empty ones. It is also possible to install only one central cash box per gaming table regardless of the number of bill discriminators. In such a configuration a transportation assembly positioned within or below the top of the gaming table will carry valid notes to a cash box and will return invalid notes to the player.

Once the bill discriminator determines the denomination and authenticity of the received note, the bill discriminator may send a signal to an LCD display 54 visible to the dealer and/or the player to indicate how much money a particular player has inserted. The LCD display 54 may indicate the total amount received, or list all of the bills and their amounts in addition to the total amount received. Further, by providing a numeric LCD display 54 showing the amount of received on the surface of the gaming table, security cameras can more readily monitor the intake of money or notes and disbursement of chips by the operator. After giving the equivalent amount in casino tokens to the player, the dealer can reset the reading on the LCD display. In this manner, the dealer can still control when the bets are placed, but doesn't waste time in collecting, counting and verifying the authenticity of the notes collected. In the event the notes are rejected, the notes may be returned through the slot used for inserting money or a separate slot for rejected notes.

Figure 7:
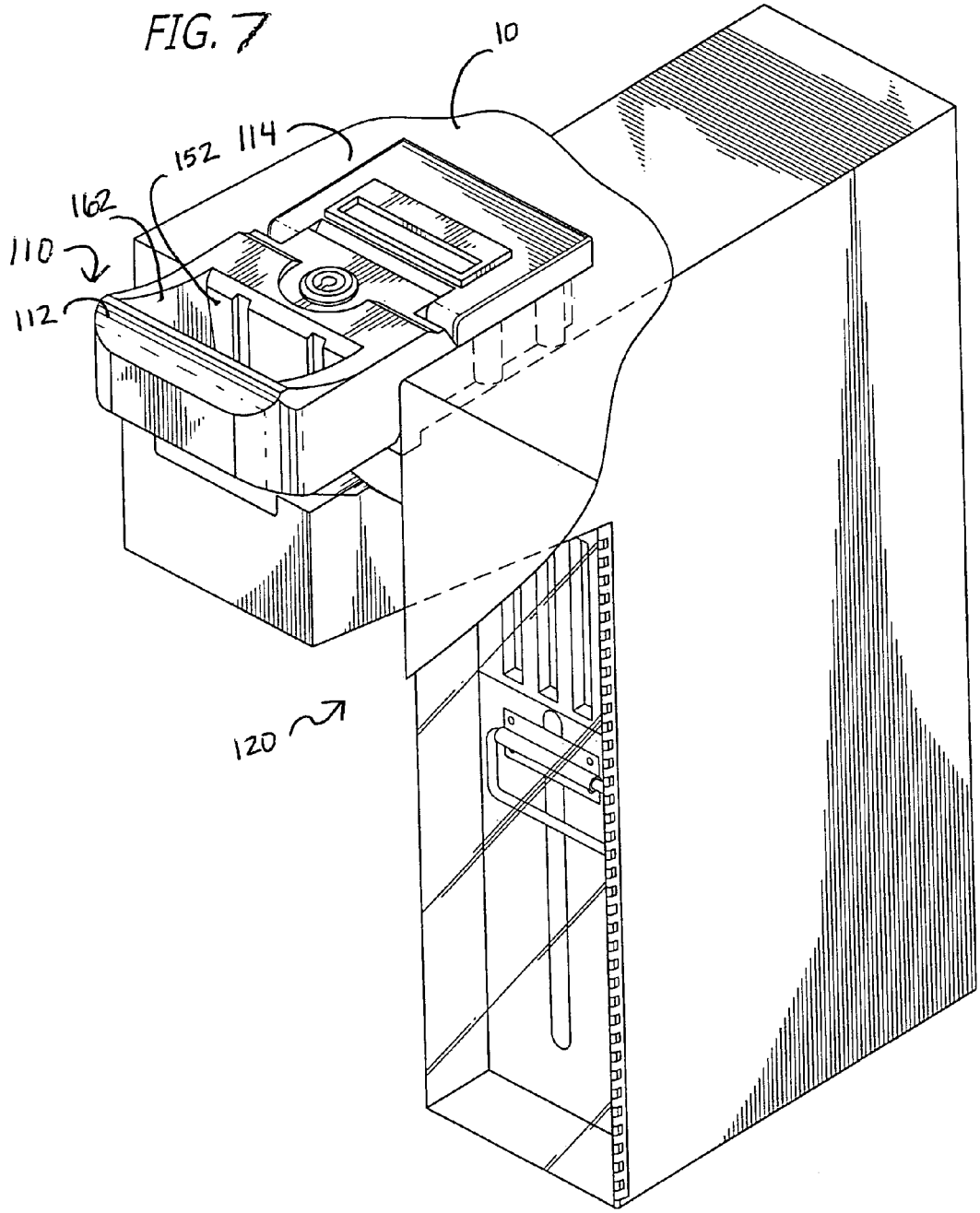
FIG. 7 is a perspective view of yet another embodiment of a bill acceptor for mounting on a gaming table.

FIG. 7 depicts another embodiment of the invention. In FIG. 7, a bill acceptor 120 is to be mounted on the gaming table 10 in a manner whereby a bulk note feeder assembly 110 is positioned at the edge of the gaming table 10 next to where the dealer will stand. The bulk note feeder assembly 110 includes a bulk note chute 112 having a tapering and curving cross sectional configuration allowing the dealer to insert a stack of up to twenty or thirty notes into the bill acceptor 120. The bill separator described above will be enclosed in a housing 134 and positioned opposite a bottom opening of the bulk note chute 112 to sequentially pull the notes from the bulk note chute 112 into the bill acceptor 20. Notes to be rejected (if the computer software is so programmed) are passed to a note dispense assembly 114 positioned on the gaming table 10 inset from the bulk note chute 112. The bulk note chute 112 is pivotally mounted to the note dispense assembly 114 such that the bulk note chute 112 can swing upward and provide access to the bill separator and validator assembly within the housing 134. A lock assembly may be provided to fix the bulk note chute 112 in place.

The bill acceptor 120 may be mounted onto the table 10 or along the edge of the table 10 so that the location of the bill acceptor 120 is convenient to use for the dealer and the housing 134, which encloses the validator assembly 30 and the cash box 40, is hidden under the table 10. For instance, in a gaming table application, the bill acceptor 120 may be coupled to an edge of a gaming table 10 so that the bulk note chute 112 is located near a dealer's right hand. The bulk note chute 112 has an intake opening 136 adapted to receive the notes. For instance, the intake opening 136 may receive thirty or more notes at one time.

To mount the bill acceptor 120 to the edge of a gaming table 10, a cavity 138 may be formed on the edge of the gaming table 10. The cavity 138 may be cut into the gaming table 10 and sized to receive a neck portion 140 of the bulk note feeder assembly 112 so that the note dispense assembly 114 protrudes from the top surface of the gaming table 10 while the housing 134 is located underneath the gaming table 10. The bulk note chute 112 protrudes from the edge of the gaming table 10. Drinks that may be accidentally spilled onto the gaming table are prevented from entering the bulk note chute 112 and the note dispense assembly 114. Alternatively, the bulk note feeder assembly 110 may be configured so that the top surface is flush with the top surface of the gaming table 10 once it is mounted to the gaming table 10.

One or more notes inserted into the intake opening 136 are sequentially processed by the validator assembly 30, as described above, to determine whether each of the notes is valid or not. The validator assembly 30 may have an inlet slot 28 (shown in FIG. 13) that is adapted to take in one note at a time from the plurality of notes inserted into the intake opening 136 of the bulk note chute 112. In particular, the inlet slot 28 may take in each of the plurality of notes along the narrow edge of the rectangular shape note. As such, the notes inserted into the intake opening 136 of the bulk note chute 112 will be provided to the inlet slot 28 of the validator 30 along a predetermined orientation, i.e., along the narrow edge of the rectangular shape note. The validator assembly 30 and cash box 40 held within the housing 134 may be placed underneath the gaming table 10 for safe keeping and out of the way of the dealer and players around the gaming table. With the intake opening 136 of the bulk note feeder assembly 110 protruding from the side 142 of the gaming table, a dealer may locate the intake opening 136 by touch and insert the notes into the intake opening 136 to minimize losing eye contact with the players around the table while dropping the notes into the intake opening 136 of the note feeder 132.

FIG. 8 is a top view of the bulk note feeder assembly 110 showing the intake opening 136 adapted to receive notes and the note dispense assembly 114 having a note rejection slot 144 adapted to dispense notes that are invalid or cannot be authenticated by the validator assembly 30. The notes inserted into the intake opening 136 may be transported to the validator assembly 30 located underneath the gaming table 10 to determine whether each of the notes is valid or not. The valid notes may be stored in the cash box 40 provided within the housing 134. The invalid notes or notes that cannot be authenticated by the validator assembly 30 may be rejected through the note rejection slot 144. The intake opening 136 and the note rejection slot 144 may be provided on the top surface of the note feeder 132 to allow a dealer to conveniently insert at least one note into the intake opening 136, and retrieve the rejected notes, if any, from the rejection slot 144.

Figure 13:
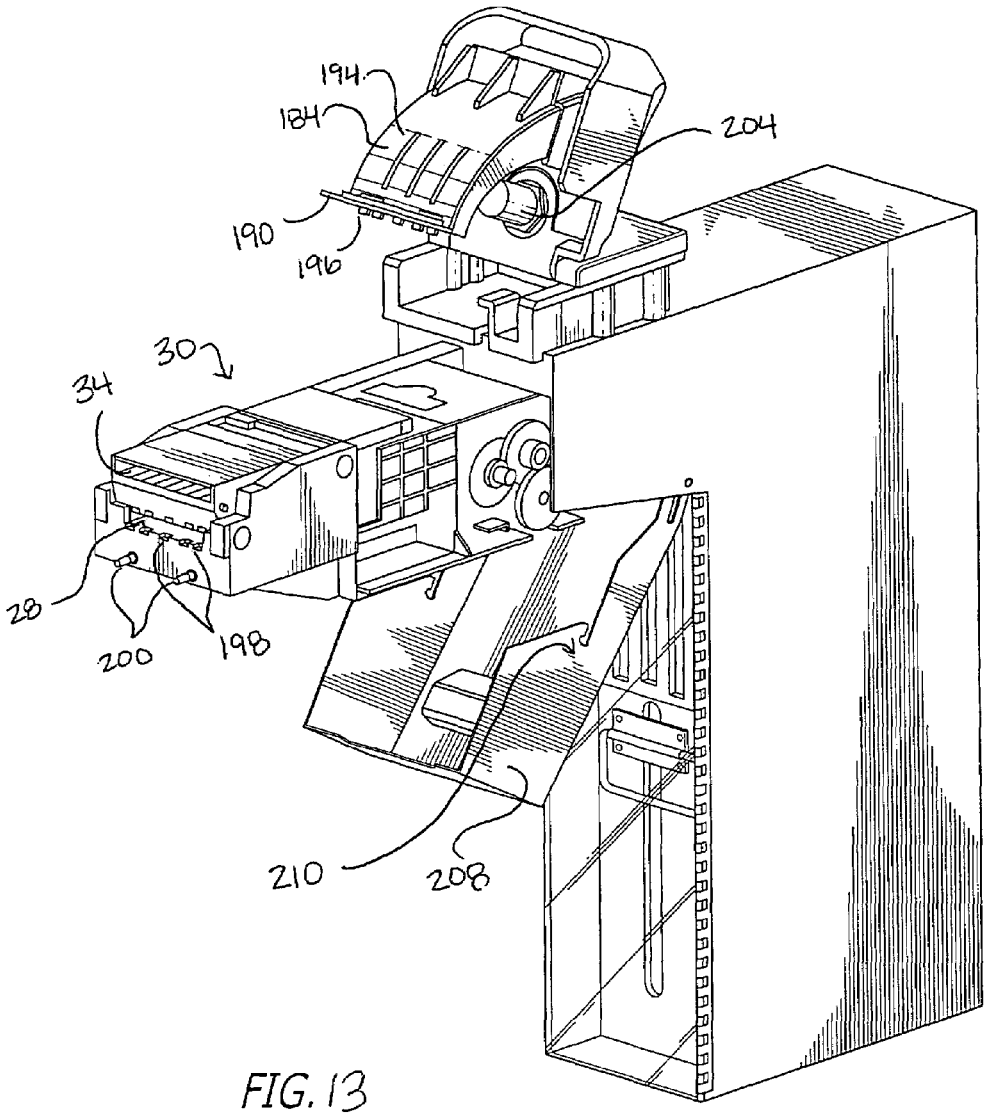
FIG. 13 is a perspective view of the bill acceptor of FIG. 7 with a note feeder rotated upward and with the validator assembly being pulled out.

A hinge 130 may be provided between the bulk note chute 112 and the note dispense assembly 114 to allow the bulk note chute 112 to pivot between a downward position (as shown in FIG. 9) and an upward position (as shown in FIG. 13) relative to the note dispense assembly 114. The hinge 130 may be configured such that when the bulk note chute 112 is in the upward position, the hinge 130 may maintain the bulk note chute 112 in the upward position without a holding pin or other staying device. The bulk note chute 112 may include a lock assembly 128 so that when the bulk note chute 112 is in the downward position, the lock assembly 128 locks the bulk note chute 112 in place relative to the note dispense assembly 114 to prevent the bulk note chute 112 from pivoting upwards. As discussed in more detail below, when the bulk note chute 112 is in the upward position, the inlet slot 28 of the validator assembly 30 may be exposed and the validator assembly 30 may be withdrawn from the housing 134 for maintenance.

Figure 10:
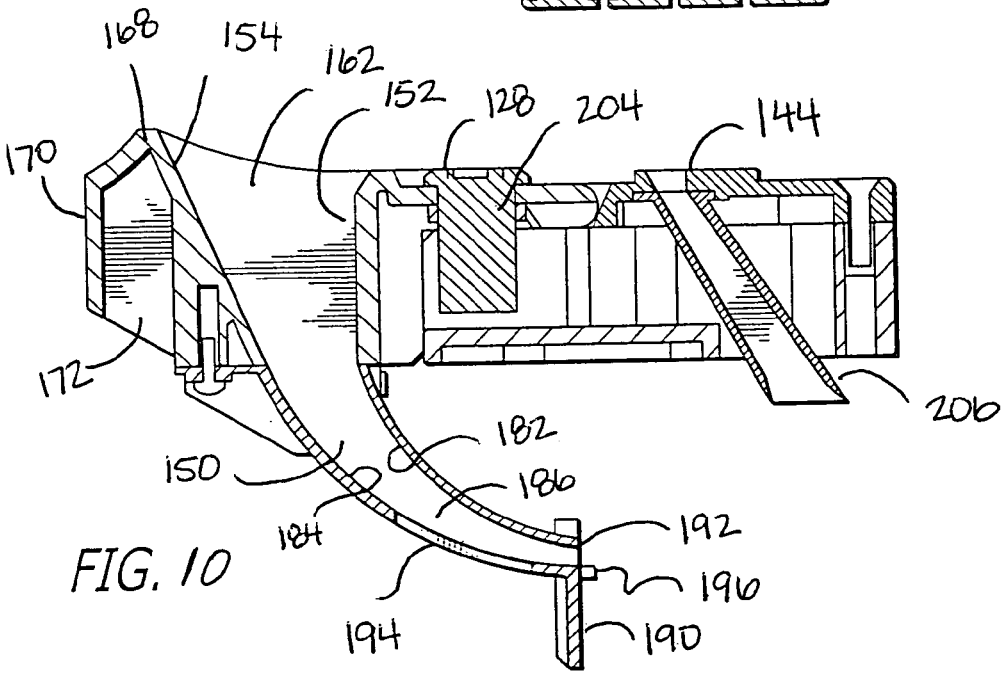
FIG. 10 is a cross sectional cutaway side view of the note feeder portion of the bill acceptor of FIG. 7.

FIGS. 9 and 10 show a side view, and a cross-sectional cutaway view, respectively of the bulk note feeder assembly 110 as illustrated in FIG. 7. As illustrated in FIGS. 7-10, the bulk note chute 112 is defined by an inner wall 152 which, in the construction as shown in FIG. 7, is essentially aligned with the edge of the table 10. Opposite the inner wall 152 is the outer wall 154, which is slanted inward toward the inner wall 152 to define the bulk note chute 112. The front outer wall 154 preferably includes a tactile indicator 158 which may include raised or depressed lettering, an arrow or dollar signs, etc. as depicted in FIG. 8. Oppositely disposed side walls 162 and 164 extend from the inner wall 152 to the outer wall 154 to define the side boundaries of the bulk note chute 112. The side walls 162 and 164 are either curved or taper towards one another at their lower edges. The taper is adapted so that bills which are not edgewise aligned can be dropped into the top of the bulk note chute 112 and, as they drop out the bottom of the bulk note chute 112, they will be more organized edgewise by the tapering effect of the side walls 162 and 164. A display panel 166 may be incorporated into a surface of either the inner wall 152 or the outer wall 154. Alternatively, the display panel 166 can be incorporated onto the note dispense assembly 114.

As best depicted in the side view of FIG. 9 and the cross-section view of FIG. 10, the outer wall 154 extends up higher than the inner wall 152. This may provide a raised surface so that when the dealer brings the notes backward from the table, they can be placed into the bulk note chute 112 and engaged against the outer wall 154 thereof without first dropping below the level of the table 10. As also illustrated in the cross-sectional view of FIG. 10, the outer wall 154 extends up to a crest 168 from which it extends outward and then downward as shown at handle 170 to form a recess 172 suitable for gripping and lifting the bulk note chute 112 upward.

Attached to the bottom of the walls forming the intake opening 136 is the chute 150. The chute 150 is defined by a top wall 182 which intersects and transitions from the bottom of the inner wall 152 of intake opening 136. The bottom of chute 150 is formed by the bottom wall 184 which extends from a smooth transition at the bottom of outer wall 154 and gradually curves from a vertically upward angle to a horizontal termination point at the bottom of the chute 150. Side walls 186 and 188 are continuous with the side walls 162 and 164, respectively, and together with the bottom wall 184, define the channel of the chute 150. At the lower edge of the chute 150 is a flange assembly 190 which allows interconnection and securement to the front edge of the validator assembly 30 so that an outlet slot 192 formed at the bottom of chute 150 aligns with the inlet slot of the validator assembly 30.

The bottom wall 184 of chute 150 may include one or more slots or holes 194 which do not interfere with the progress of the bill or stack of notes as it progresses over the surface of the bottom wall 184. The holes 194 prevent liquids poured or spilled into the bulk note chute 112 from passing from the bulk note chute 112 into the bill validator assembly 30. As illustrated, the cross-sectional view of FIG. 10, the surfaces of the bulk note chute 112 and in particular the transition between intake opening 136 and the chute 150 are configured so as to allow the smooth progression of notes inserted to the intake opening 136 down through chute 150 and so that they can be provided to the validator assembly 30. If a stack of notes having a thickness greater than the width or height of the channel chute 150 at its base are placed into the intake opening 136, the upper most notes will be constrained by the top wall 182 until enough notes are removed from the bottom of this stack by the validator assembly 30 to allow all of the notes to drop to the bottom and, sequentially, be pulled into the validator assembly 30. By this configuration, a stack of notes may be quickly and efficiently processed once inserted into the intake opening 136 by the bill acceptors 120.

Before inserting a plurality of notes into the intake opening 136, a dealer may organize the plurality of rectangular shape notes so that they are roughly aligned relative to each other. The dealer may then insert the plurality of the notes along their narrow edges first into the intake opening 136. The outer wall 154 of the intake opening 136 may have a tactile indicator 158 such as an arrow which points in the downward direction. The tactile indicator 158 may be in the form of a large recessed arrow. The tactile indicator 158 may optionally include sensors to detect the motion of the notes passing through the chute 150 to monitor the location of the notes within the chute 150. Depending on the location of the notes in the chute 150, the tactile indicator 158 functions as a touch sensed indicator for the dealer or user that the notes inserted into the intake opening 136 may need to be pushed further into the chute 150.

The tactile indicator 158 may be back lit to indicate that the note or a stack of notes need to be pushed further into the chute 150. Once inserted into the chute 150, the notes may be then transported by gravity or a vacuum down the note chute 150 toward the inlet slot 28 of the validator assembly 30. The chute 150 has a smooth curved configuration so that the notes may be inserted substantially along the vertical axis into the intake opening 136 and exit out of the chute 150 substantially along a horizontal axis. The curved configuration of the chute 150 aligns the stack of rectangular shape notes so that the notes exit through the outlet 192 in an orderly fashion along their narrow edges and into the inlet slot 28 of the validator assembly 30. The validator assembly 30 may be provided with the bill separator 36, as described above, to pull one note at a time from the notes provided through the chute 150.

The chute 150 may be secured to the note feeder 132 via fastening mechanisms such as screws. The internal surfaces of the chute 150 may be coated with a substance to minimize the friction between the interior surface of the chute 150 and the notes so that the notes pass through the chute 150 easily.

When the bulk note chute 112 is in the downward position, a set of fingers 196 located below the outlet 192 insert into openings in the validator assembly 30 so as to align the chute 150 and validator assembly 30. A set of pins 200 on the validator assembly 36 may act as sensors such that when the chute 150 is coupled to the validator assembly 30, the sensor pins 200 indicate to the validator assembly 30 that the bulk note feeder assembly 110 is in the downward position. Once the validator receive a signal from the sensors, the validator 30 may indicate through the display panel 166 that bill acceptor 130 is able to receive notes. In addition, a variety of information about the notes may be provided to the display panel 166. For instance, the validator assembly 30 may provide information about the total amount of notes inserted. The different denominations of notes included in a stack of notes, and rejected notes, if any, from the stack of notes. The validator assembly 30 may also provide information about the working status of the bill acceptor 120 and the validator assembly 30. The validator assembly 30 may also be connected to a network within a casino so that dealers can be provided with messages through the display panel 166 on each of the gaming tables.

Figure 11:
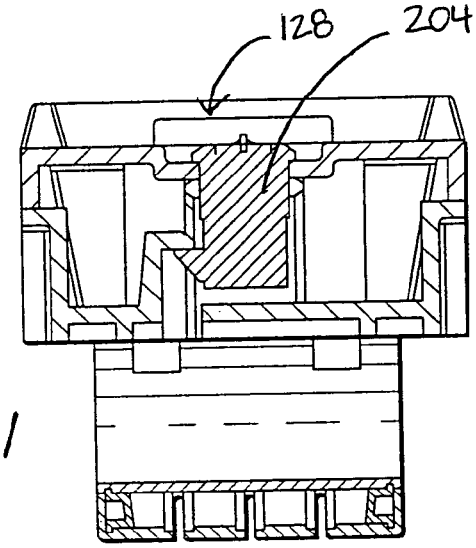
FIG. 11 is cross-sectional view of the lock assembly of the note feeder portion of the bill acceptor along a line 11-11 shown in FIG. 8.

FIG. 11 illustrates a cross-sectional view of the lock assembly 128 along the line 11-11 shown in FIG. 8. The lock assembly 128 may have a lock cylinder 204 adapted to receive a key to rotate the lock assembly 128 between locked and unlocked positions. In the unlocked position, the bulk note feeder assembly 110 may pivot upward relative to the note dispense assembly 114 and move between the downward and upward positions. In the unlocked position, the note feeder 132 of the bulk note chute 112 may be detached from the note dispense assembly 114 and the chute 150 so that the note feeder 132 may be replaced with a note feeder having different dimensions configured to receive different sized notes. This way, currencies from other countries may be inserted into the note feeder 132 of the bill acceptor 120.

The cross-sectional view of FIG. 10 of the bulk note feeder assembly 110 best illustrates note dispense chute 206 within the note dispense assembly 114. The note dispense chute 206 extends from a bill dispense slot 34 on the top of validator assembly 30 to the note rejection slot 144 of the note dispense assembly 114. In FIG. 6, the bill dispense slot 34 of the validator assembly 30 is shown on the back end of the housing 22. Alternatively, the bill dispense slot 34 may be formed on a forward top surface of the housing 22 so that notes rejected through the bill dispense slot 34 may be provided to the note dispense chute 206 located above the bill dispense slot 34. If one or more notes cannot be validated or authenticated by the validator assembly 30, then the invalid note may be rejected through the bill dispense slot 34 of the validator assembly 30 and passed to the note dispense chute 206 which directs the invalid note to the note rejection slot 144. A dealer may retrieve the invalid note from the note rejection slot 144 and give back the invalid note to the player who provided the invalid note to the dealer. Depending on the venue in which the bill acceptor is employed, i.e., gaming table, kiosk or the like, the note dispense chute 186 may or may not be employed.

Figure 12:
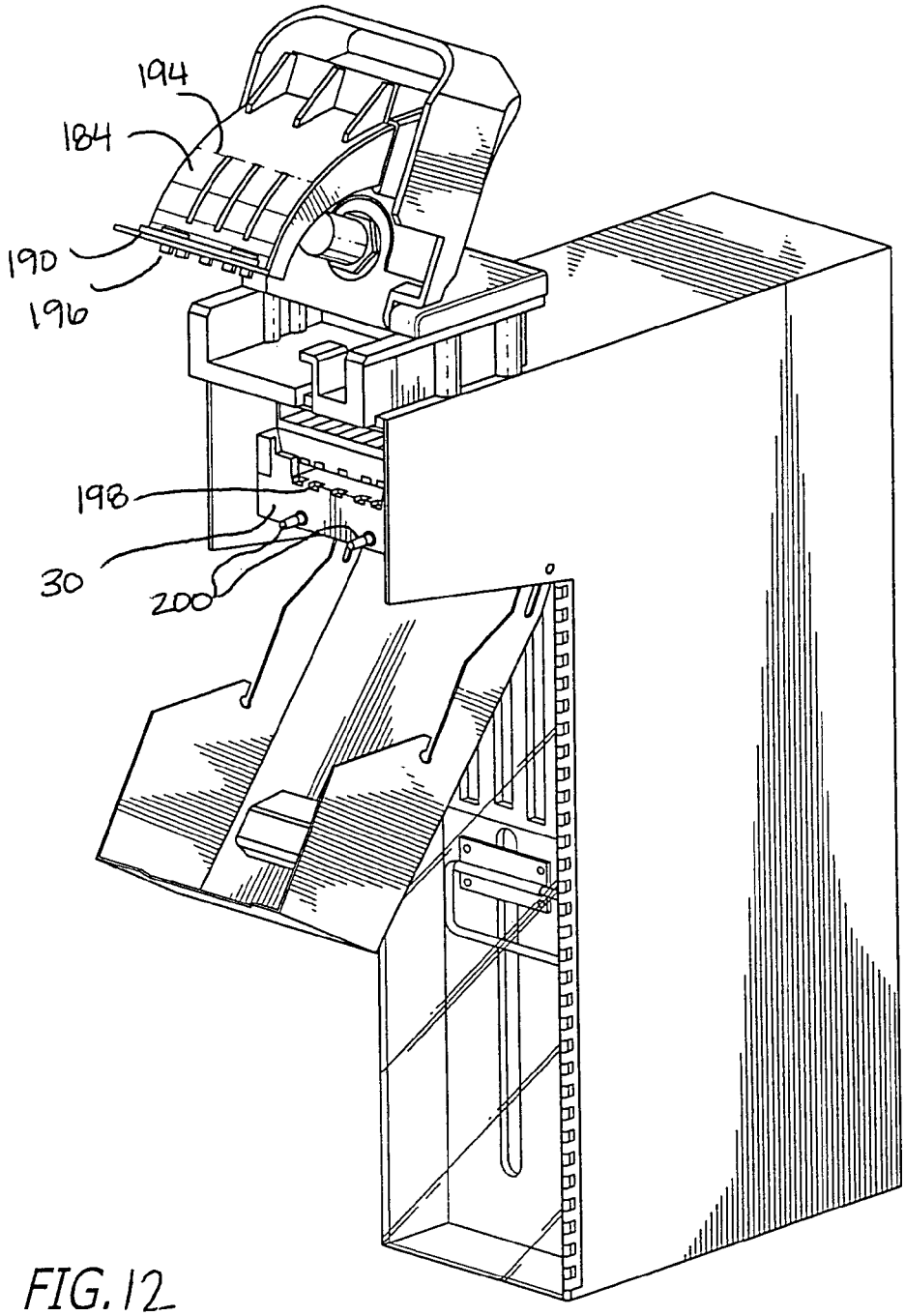
FIG. 12 is a perspective view of the note feeder portion of the bill acceptor rotated to expose the validator assembly.

FIG. 12 illustrates the bulk note chute 112 in the upward position which exposes the validator assembly 30. FIG. 13 illustrates that once the bulk note chute 112 is in the upward position, the validator assembly 30 may be withdrawn from the housing 134 for maintenance or servicing. This figure illustrates the inlet slot 28 and the bill dispense slot 34 of the validator assembly 30. The validator assembly 30 may be removed or withdrawn partially without exposing the cash box 40 within the housing 134 to minimize the risk of the cash box being stolen or being tampered with by an unauthorized person. This allows a technician to troubleshoot the validator assembly 30 in the event of a jam without having to disassemble the entire bill acceptor 120.

The housing 134 may have a lower jaw 208 adapted to pivot about a pivot point 210 on the housing 134. The lower jaw 208 may pivot between a lower position as shown in FIG. 13 and an upward position as shown in FIG. 7. The lower jaw 208 may have locking edges 210 adapted to engage with the flange of the chute 150 when the bulk note feeder assembly 110 is in the lower position, and the lower jaw 208 is pushed up towards the upward position.

Having thus described different embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A bill acceptor for validating currency and notes exchanged for chips for use on a gaming table, the bill acceptor comprising:

a bulk note feeder on the bill acceptor at the gaming table, the bulk note feeder having a note dispense assembly and a note feeder including a bulk note chute to receive at least one note inserted through an intake opening and to hold said at least one note until it can be extracted through an outlet slot at an opposite end of said bulk note chute from said intake opening;

a validator mounted underneath the plane of the surface of the gaming table, the validator configured to validate notes received from said note feeder;

a cash box mounted underneath the plane of the surface of the gaming table to receive and store notes from said validator;

a housing to enclose the validator and the cashbox underneath the plane of the surface of the gaming table; and said bulk note chute is connected to said note dispense assembly so that said bulk note chute can pivot relative to said note dispense assembly such that at least a portion of said validator can be withdrawn from said housing when said bulk note chute is in said upward position.

2. The bill acceptor of claim 1, wherein said bulk note chute is configured to allow notes to be inserted substantially along a vertical axis through said intake opening and passed substantially along a horizontal axis through said outlet slot to said validator.

3. The bill acceptor of claim 1, where said bulk note chute has a bottom channel wall including at least one open slot.

4. The bill acceptor of claim 1, where the bulk note feeder has a note dispense assembly and said bulk note chute is connected to said note dispense assembly on a hinge so that said bulk note chute can pivot between an upward position and a downward position relative to said note dispense assembly.

5. The bill acceptor of claim 2, wherein the note feeder has a tactile indicator.

6. A bill acceptor for validating currency and notes exchanged for chips for use on a gaming table, the bill acceptor comprising:

a bulk note feeder on the bill acceptor at the gaming table, the bulk note feeder having a note feeder including a bulk note chute to receive at least one note inserted through an intake opening and to hold said at least one note until it can be extracted through an outlet slot at an opposite end of said bulk note chute from said intake opening, the bulk note feeder having a note dispense assembly and said bulk note chute is connected to said note dispense assembly on a hinge so that said bulk note chute can pivot between an upward position and a downward position relative to said note dispense assembly;

a validator mounted underneath the plane of the surface of the gaming table, the validator configured to validate notes received from said note feeder;

a cash box mounted underneath the plane of the surface of the gaming table to receive and store notes from said validator;

said bulk note chute being movable to provide access to said validator; and a housing configured to enclose the validator and the cash box underneath the plane of the surface of the gaming table such that when the bulk note chute of the bulk note feeder is in the upward position, at least a portion of the validator can be withdrawn from the housing.

7. The bill acceptor of claim 6, where the note dispense assembly has a note rejection slot for dispensing of invalid notes.

8. The bill acceptor of claim 6, including a lock assembly to lock the note feeder in an operative position.

9. A bill acceptor adapted to use on a table said table having a top surface, the bill acceptor comprising:

a note feeder having a first portion and a second portion said first and second portions substantially aligned with the top surface of the table, the first portion having a note feeder including an intake opening to a bulk note chute terminating at an outlet slot configured to receive a stack of notes inserted through said intake opening and pass said notes through said outlet slot, and the second portion having a rejection slot to dispense invalid notes, wherein said first portion is pivotally connected to said second portion such that it can be rotated from a downward position to an upward position;

a cash box to store notes;

a validator having an inlet slot and a bill dispense slot, the validator configured to validate notes received from said bulk note chute's outlet slot through the inlet slot of said validator and separate valid notes and invalid notes, the validator further configured to pass valid notes to the cash box and pass invalid notes through the bill dispense slot to dispense the invalid notes through the rejection slot of the note feeder; and a housing configured to enclose the validator and the cash box, such that said validator can be at least partially withdrawn when said first portion of said note feeder is in said upward position.

10. The bill acceptor of claim 9, including a note chute configured to organize and pass notes from the intake opening of the note feeder to the inlet slot of the validator.

11. A bulk note feeder assembly for feeding notes to a bill validator, the bulk note feeder assembly comprising:

a note dispense assembly for mounting to a table;

a bulk note chute for movable attachment to said note dispense assembly, the bulk note chute having an intake opening transitioning to a tapered chute to an outlet slot at an opposite end of said tapered chute from said intake opening, said bulk note chute configured to receive a stack of notes inserted through said intake opening, stack said notes in said tapered chute and direct the notes through said outlet slot to the bill validator; and wherein said movable attachment of said bulk note chute can move from a first position to a second position to provide access to withdraw said bill validator when said bulk note chute is in said second position.

12. The bulk note feeder assembly of claim 11 wherein said intake opening and said tapered chute of said bulk note chute are defined by an inner wall, an outer wall slanted toward said inner wall and side walls transitioning toward one another and extending from said inner wall to said outer wall.

13. The bulk note feeder assembly of claim 12 wherein said outer wall includes a tactile indicator.

14. The bulk note feeder assembly of claim 11 wherein said bulk note chute includes a curving chute defined by a top wall, bottom wall and oppositely disposed sidewalls extending from said top wall to said bottom wall.

15. The bulk note feeder assembly of claim 11 wherein said bulk note chute is pivotally attached to said note dispense assembly.

16. A method of validating notes received at a gaming table, the method comprising:

providing a note feeder with an intake opening mounted along the edge of the gaming table, the intake opening configured to receive and arrange a stack of notes;

mounting a validator in a housing below the plane of the surface of the gaming table to validate the notes and separate valid notes from invalid notes;

mounting a cash box in said housing below the plane of the surface of the gaming table to store the valid notes from the validator;

providing a rejection slot on the note feeder atop the gaming table to dispense invalid notes from the validator;

providing a bulk note chute pivotally mounted to said note feeder such that it can be rotated between a downward position and an upward position; and wherein said validator can be at least partially withdrawn from said housing when said bulk note chute is in said upward position.

* * * * *